US006537049B2

(12) United States Patent
Schofield et al.

(10) Patent No.: US 6,537,049 B2
(45) Date of Patent: Mar. 25, 2003

(54) SCREW PUMP HAVING A THERMAL SHIELD

(75) Inventors: Nigel Paul Schofield, Horsham (GB); Michael Henry North, Reigate (GB)

(73) Assignee: The BOC Group, plc, Windlesham (GB)

( * ) Notice: Subject to any disclaimer, the term of this patent is extended or adjusted under 35 U.S.C. 154(b) by 0 days.

(21) Appl. No.: 10/035,889

(22) Filed: Nov. 7, 2001

(65) Prior Publication Data

US 2002/0057979 A1 May 16, 2002

Related U.S. Application Data

(63) Continuation of application No. 09/595,322, filed on Jun. 16, 2000, now abandoned.

(30) Foreign Application Priority Data

Jun. 16, 1999 (GB) ..... 9913969

(51) Int. Cl.[7] ..... F04C 18/16; F04C 29/04

(52) U.S. Cl. ..... 418/201.1; 418/83; 418/104; 418/141

(58) Field of Search ..... 418/83, 91, 104, 418/141, 201.1

(56) References Cited

U.S. PATENT DOCUMENTS

| | | | | |
|---|---|---|---|---|
| 3,826,589 A | | 7/1974 | Frank et al. | 415/170 A |
| 4,720,248 A | | 1/1988 | Dernedde et al. | 417/373 |
| 5,810,568 A | | 9/1998 | Whitefield et al. | 417/423.8 |
| 5,924,855 A | * | 7/1999 | Dahmios et al. | 418/201.1 |

FOREIGN PATENT DOCUMENTS

| | | | | |
|---|---|---|---|---|
| DE | 1293383 | * | 4/1969 | 418/201.1 |
| DE | 31 51 869 A1 | | 7/1983 | |
| JP | 3-213688 | * | 9/1991 | 418/201.1 |

* cited by examiner

*Primary Examiner*—John J. Vrablik
(74) *Attorney, Agent, or Firm*—Wan Yee Chung; Salvatore P. Pace

(57) ABSTRACT

A screw pump has two parallel shafts mounted in a pump body, each shaft thereon and each rotor has at least one helical vane or thread. When the helical vanes or threads inter mesh causing a fluid to be pumped from an inlet towards an outlet of the pump. The bearings associated with each shaft are being positioned in cavities within the first and second rotors which are sealed at their ends closest to the pump inlet. A thermal shield is provided between the bearing arrangements and the internal cavity surfaces.

11 Claims, 2 Drawing Sheets

SCREW PUMP HAVING A THERMAL SHIELD

This is a continuation of U.S. application Ser. No. 09/595,322, filed Jun. 16, 2000 now abandoned.

BACKGROUND OF THE INVENTION

The present invention relates to vacuum pumps and more particularly to screw pumps.

Screw pumps usually comprise two spaced parallel shafts each carrying eternally threaded rotors, said shafts being mounted in a pump body such that the threads of the rotors intermesh. Close tolerances between the rotor threads at the points of intermeshing and with the internal surface of the pump body, which acts as a stator, causes volumes of gas being pumped between an inlet and an outlet to be trapped between the threads of the rotors and the internal surface and thereby urged through the pump as the rotors rotate.

Such screw pumps are potentially attractive since they can be manufactured with few working components and they have an ability to pump from a high vacuum environment at the inlet down to atmospheric pressure at the outlet.

The shafts of conventional screw pumps can be either mounted in cantilever fashion within the pump body or supported at each end with bearings using a common head plate or plates to support the bearing or bearings of both shafts. The head plate or plates are then fixed to the pump body.

Screw vacuum pumps are commonly used in the semiconductor industry and, as such, need to be capable of maintaining a clean environment associated with semiconductor device processing, especially in that area of the pump—the pump inlet—closest to the semiconductor processing chamber to which the pump is attached.

Screw vacuum pumps are known in which the rotors are positioned, and adapted for rotation, in the pump body by means of shaft bearings present wholly or partly inside hollow cavities in the rotors which are sealed at the ends closest to the pump inlet. A disadvantage of such pumps, however, is that the high rotational speeds of operation generate considerable heat, especially if the rotors/threads are designed to compress the volumes of gases as they pass through the pump. In other instances, particularly in the semiconductor industry, the pump is operated at high temperatures to avoid the possibility of certain substances being pumped, for example ammonium chloride, condensing on the internal surfaces of the plump.

Because of these high operating temperatures, the internal bearings inside the hollow rotors have to be cooled to prevent heat from the screw rotors from damaging the bearings. This can be achieved, for example, by water cooling the bearing carriers. However, the presence of such cooled bearing carrier surfaces within the pump allows for the possibility of condensation of condensable substances which is clearly undesirable as it may quickly hinder the efficient operation of the pump as a whole.

The present invention is concerned with the provision of an improved vacuum pump designed to overcome such disadvantages.

SUMMARY OF THE INVENTION

In accordance with the invention, there is provided a screw pump comprising a first shaft spaced from and parallel to a second shaft mounted in a pump body, a first rotor mounted on the first shaft and a second rotor mounted on the second shaft, each rotor having formed on an outer surface at least one helical vane or thread, the helical vanes or threads intermeshing together so that rotary movement of the shafts will cause a fluid to be pumped from an inlet towards an outlet of the pump, a first bearing arrangement associated with the first shaft and a second bearing arrangement is associated with the second shaft, first and second bearing arrangement being positioned in cavities within the first and second rotors respectively which are sealed at their ends closest to the pump inlet wherein a thermal shield is provided between the bearing arrangements and the internal cavity surfaces.

A thermal (or heat) shield is advantageously placed around the bearing carrier or carriers for each shaft. Preferably the shields are spaced apart from the bearings/bearing carriers to define a gap therebetween.

In preferred embodiments the thermal shield(s) comprises a tubular body surrounding the bearing(s) or bearing carrier (s).

In further preferred embodiments, the thermal shield includes seal means between it and the screw rotor in order to minimise the amount of pumped gases (or other contaminants) which might penetrate the cavity between the screw rotor and the thermal shield. This can be important because the end of the shield furthest into the screw rotor cavity is generally less hot than the end nearer the pump exhaust and the further end of the cavity is therefore more susceptible to condensation (or other deposition) by condensable substances.

A labyrinth seal is preferred for the seal between the thermal shield and the screw rotor, for example positioned on the thermal shield end adapted for close tolerance (non-contact) positioning relative to the (rotating internal rotor cavity surfaces.

To minimize the possibility of an ingress of powders or other particles past the seal, centrifugal means can be employed, for example, by having a plurality of blades at the end of the screw rotors angled to deflect any powder/particles outwardly and away from the rotor cavity, or by providing an angled separation between the rotor and the shield to spin the gas (and entrained powder/particles) away by a viscous drag mechanism instead of using blades.

DETAILED DESCRIPTION OF THE INVENTION

Figure 1:
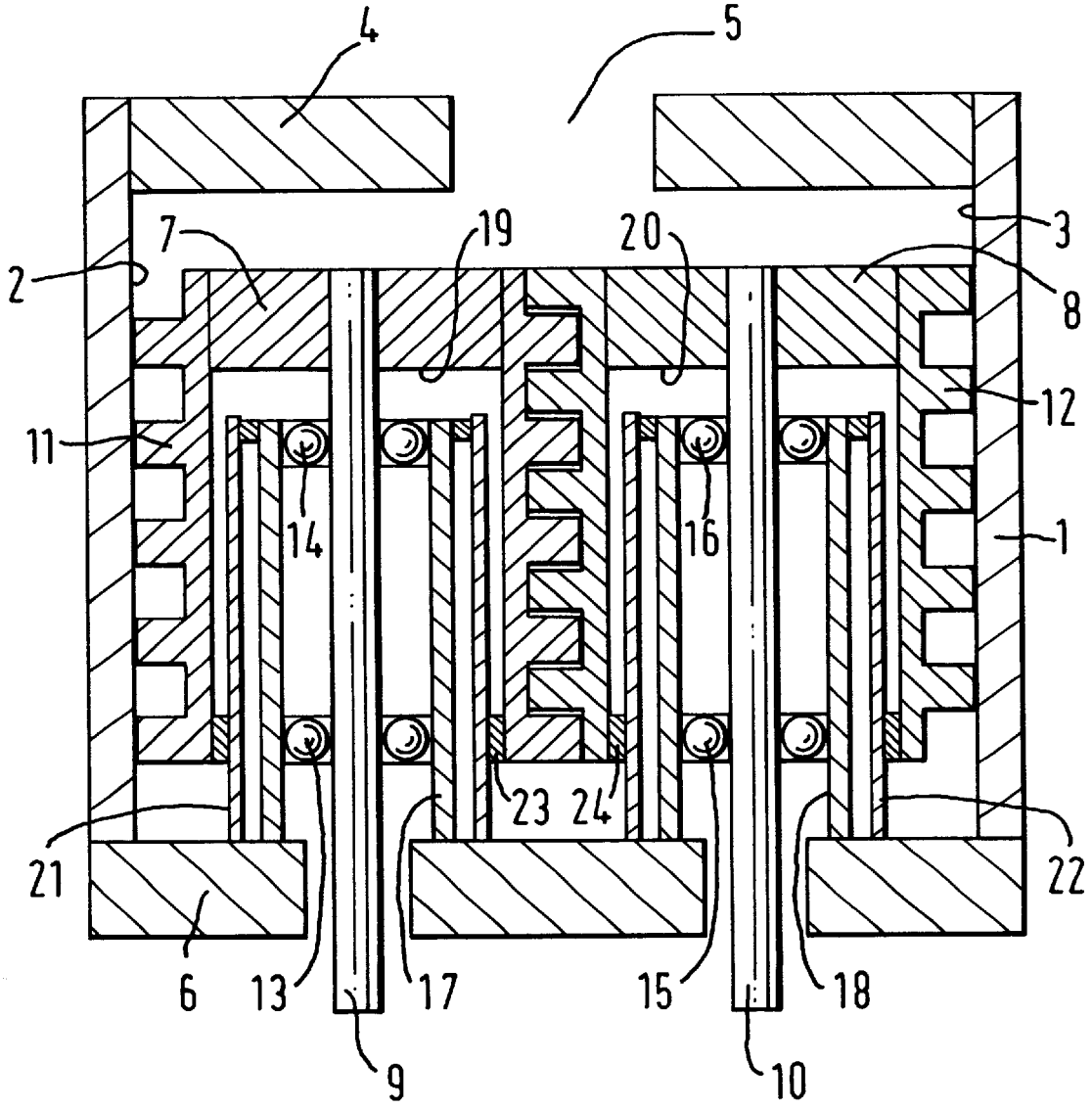
FIG. 1 shows a schematic cross-sectional view of a vacuum pump according to the present invention.
Figure 2:
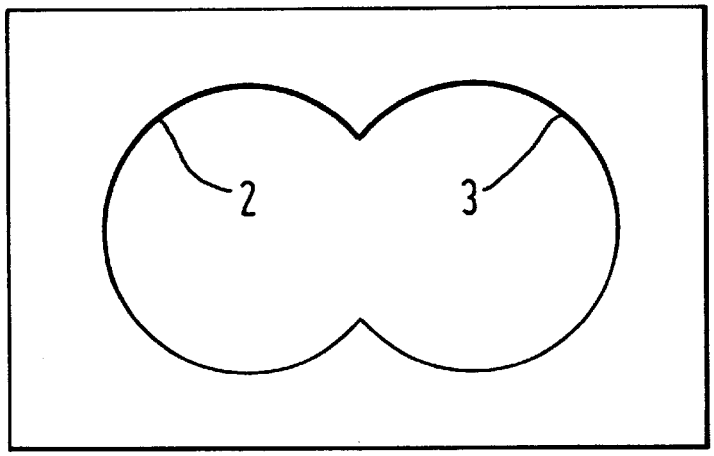
FIG. 2 shows a diagrammatic section, not to scale, through the pump body of FIG. 1.

With reference to the drawings and with particular reference to FIG. 1, there is shown a screw vacuum pump of the invention including a main body 1 whose internal surfaces define two linked bores 2, 3 which together form a "figure-of-eight" shape as shown in FIG. 2.

The main body 1 has a top portion 4 in which is defined a pump inlet 5 and a lower portion 6 in the vicinity of which is defined a radially extending pump outlet (not shown).

Rotors 7, 8 are positioned in the bores 2, 3 respectively. Each rotor is attached to its respective shaft 9, 10 and is adapted for rotation about its main axis by means of an electric motor (not shown) driving the shaft 9 and with gear means (not shown) linking the shaft 9 with the shaft 10 to drive the shaft 10 at the same speed of rotation as the shaft 9 but in an opposite direction.

The rotors 7, 8 have respective continuous helical vanes (or threads) 11, 12 on their outer surfaces which vanes or threads intermesh at the pump centre as shown and which, in use of the pump, have close tolerances with the internal surfaces of the bores 2, 3 respectively.

The shafts 9, 10 are positioned in the pump body 1 by means of bearings 13, 14 and 15, 16 respectively. The sets of bearings are held in bearing carriers 17, 18 respectively fixed to the lower body portion 6 and generally extending with internal cavities 19, 20 respectively of the rotors 7, 8, each cavity 19, 20 being sealed at its end nearer the pump inlet 5. The bearing carriers are cooled by circulating cold water by means not shown.

In accordance with the invention, tubular thermal shields 21, 22 respectively are mounted in the lower body portion 6 and surround the bearing carriers 17, 18 and thereby generally separate the bearing carriers 17, 18 from the internal surfaces of the cavities 19, 20 of rotors 7, 8.

The shields 21, 22 are generally spaced from the carriers 17, 18 as well as from the rotors 7, 8 and this allows for the carriers 17, 18 (and the bearings themselves) to be operated at the low temperatures afforded by the cooling water whilst allowing the thermal shields to operate at temperatures sufficiently high—heat being transferred to them from the hot rotors—to obviate the possibility of deposition of condensable substances on to the thermal shields 21, 22.

It will be noted that there is an annular link between the thermal shields 21, 22 and their respective bearing carriers 17, 18, thereby defining substantially sealed annular gaps therebetween.

The thermal shields 21, 22 also have non-contact, seal portions 23, 24 extending towards the rotors 7, 8 respectively adjacent the bearings 13, 15 respectively.

Figure 3:
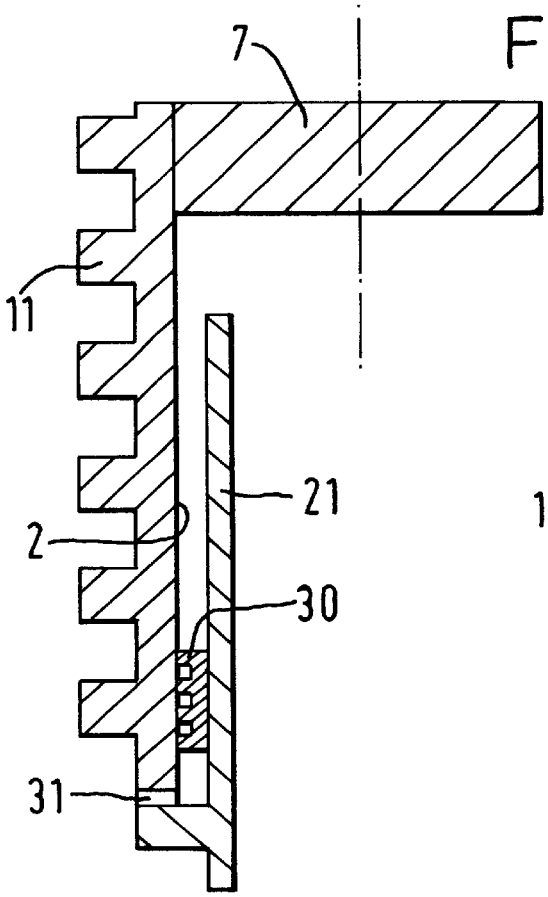
FIG. 3 shows an enlarged view of a part of the vacuum pump shown in FIG. 1 omitting some components for clarity purposes.

FIG. 3 shows an enlarged view of part of the rotor 7 and the thermal shield 21 and the presence of a labyrinth seal 30 in particular (equivalent to the seals 23, 24 of FIG. 1) mounted on the shield and with a close tolerance (non-contacting) fit with the internal surface of the bore 2 of the rotor 7. Such a labyrinth seal 30 will generally prevent ingress of powder/particles in to the rotor cavities. An inert gas, for example nitrogen, injection in to the gaps in the seal and/or into the cavity beyond the seal may assist in the prevention of such ingress if required.

FIG. 3 also shows the presence of a plurality of blades 31 on the end of the rotor 7 and evenly spaced around the end in order to assist in the ejection of powder/particles outwardly and away from the rotor cavity by centrifugal means.

Figure 4:
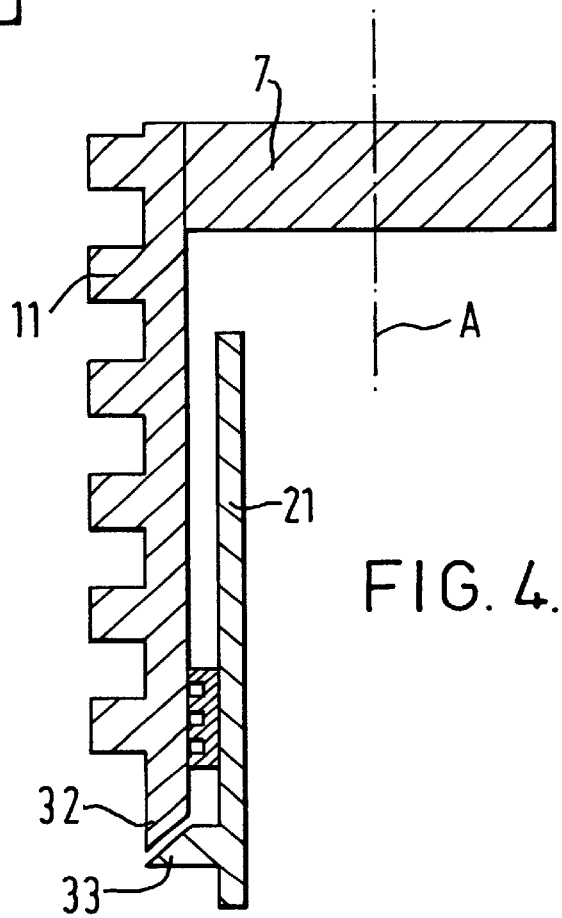
FIG. 4 shows an enlarged alternative embodiment of the part of the vacuum pump shown in FIG. 3.

FIG. 4 shows an alternative arrangement for preventing ingress of powders/particles by providing an angled end 32 to the rotor 7 and a corresponding angled surface 33 of thermal shield 21. The presence of this angled gap between these two components will have the effect of centrifugally spinning and urging gas present in this area, together with any entrained powder/particles, outwardly away generally by a viscous drag mechanism as the rotor rotates about its main axis A.

In use of the pumps of the invention, gas entering the pump inlet 5 is pumped by spinning rotors 7, 8 down the screw threads 11, 12 and in to the pump outlet (not shown) in the vicinity of the lower body portion 6 whilst generally avoiding the hot gases from contacting the bearings or their carriers and preferably not allowing the hot gases to enter the rotor cavities. The presence of the relatively hot thermal shields, however, will not generally allow for condensation of any gas which does not enter the rotor cavities.

While an embodiment of the present invention has been described in detail, it should be apparent that further modifications and adaptations of the invention will occur to those skilled in the art. It is to be expressly understood, however, that such modifications and adaptations are within the spirit and scope of the invention.

We claim:

1. A screw pump comprising a first shaft spaced from and parallel to a second shaft mounted in a pump body, a first rotor mounted on the first shaft and a second rotor mounted on the second shaft, each rotor having formed on an outer surface at least one helical vane or thread, the helical vanes or threads intermeshing together so that rotary movement of the shafts will cause a fluid to be pumped from an inlet towards an outlet of the pump, a first bearing arrangement associated with the first shaft and a second bearing arrangement associated with the second shaft, the first and second bearing arrangements being positioned in cavities within the first and second rotors, respectively, which are sealed at their ends closest to the pump inlet, wherein a thermal shield is provided between each of the bearing arrangements and internal surfaces of the cavities, and a substantially sealed annular gap is defined between the thermal shield and each bearing arrangement thereby allowing the heat shield to operate at a higher temperature than each bearing arrangement.

2. The screw pump according to claim 1 wherein the thermal shield is placed around the bearing arrangements comprising bearing or bearing carriers for each shaft.

3. The screw pump according to claim 2 wherein each thermal shield comprises a tubular body surrounding each bearing arrangement.

4. The screw pump according to claim 1 further comprising a seal means between the thermal shield and each rotor in order to minimize the amount of pumped gases which might penetrate the cavity between each rotor and the thermal shield.

5. The screw pump according to claim 4 wherein the seal means is a labyrinth seal present between the thermal shield and each rotor.

6. The screw pump according to claim 5 wherein the labyrinth seal is positioned on the thermal shield end adapted for close tolerance positioning relative to the internal rotor cavity surfaces.

7. The screw pump according to claim 4 further comprising a centrifugal means to minimize ingress of powders or other particles past the seal means.

8. The screw pump according to claim 7 wherein the centrifugal means has a plurality of blades at the end of the rotors, angled to deflect any powder/particles outwardly and away from the rotor cavity.

9. The screw pump according to claim 7 wherein the centrifugal means is provided by having an angled separation between the rotor and the thermal shield to spin the gas away.

10. A screw pump comprising a first shaft spaced from and parallel to a second shaft mounted in a pump body, a first rotor mounted on the first shaft and a second rotor mounted on the second shaft, each rotor having formed on an outer surface at least one helical vane or thread, the helical vanes or threads intermeshing together so that rotary movement of the shafts will cause a fluid to be pumped from an inlet towards an outlet of the pump, a first bearing arrangement associated with the first shaft and a second bearing arrangement associated with the second shaft, the first and second bearing arrangements being positioned in cavities within the first and second rotors, respectively, which are sealed at their ends closest to the pump inlet, a thermal shield is provided between the bearing arrangements and internal surfaces of the cavities, a centrifugal means to minimize ingress of powders or other particles past a seal means provided between the thermal shield and each rotor, and wherein the centrifugal means is provided by having an angled separation between the rotor and the thermal shield to spin any gas away.

11. A screw pump comprising a first shaft spaced from and parallel to a second shaft mounted in a pump body, a first rotor mounted on the first shaft and a second rotor mounted on the second shaft, each rotor having formed on an outer surface at least one helical vane or thread, the helical vanes or threads intermeshing together so that rotary movement of the shafts will cause a fluid to be pumped from an inlet towards an outlet of the pump, a first bearing arrangement associated with the first shaft and a second bearing arrangement associated with the second shaft, the first and second bearing arrangements being positioned in cavities within the first and second rotors, respectively, which are sealed at their ends closest to the pump inlet wherein a thermal shield is provided between the bearing arrangements and internal surfaces of the cavities, and further comprising a seal means between the thermal shield and each rotor in order to minimize the amount of pumped gases which might penetrate the cavity between the rotor and the thermal shield, a centrifugal means to minimize ingress of powders or other particles past the seal means, and wherein the centrifugal means has a plurality of blades at the end of the screw rotors, angled to deflect any powder/particles outwardly and away from the rotor cavity.

* * * * *